United States Patent [19]

Brännström

[11] Patent Number: 4,584,949

[45] Date of Patent: Apr. 29, 1986

[54] METHOD OF IGNITING A COMBUSTION CHAMBER WITH A FLUIDIZED BED AND A POWER PLANT FOR UTILIZING THE METHOD

[75] Inventor: Roine Brännström, Finspong, Sweden

[73] Assignee: Asea Stal AB, Västerås, Sweden

[21] Appl. No.: 744,173

[22] Filed: Jun. 13, 1985

[30] Foreign Application Priority Data

Jun. 13, 1984 [SE] Sweden ..... 8403162

[51] Int. Cl.[4] ..... F23G 5/00

[52] U.S. Cl. ..... 110/346; 60/39.464; 110/245; 110/263; 110/347; 122/4 D; 431/7; 431/170

[58] Field of Search ..... 431/7, 170; 110/347, 110/346, 263, 245; 60/39.464; 122/4 D

[56] References Cited

U.S. PATENT DOCUMENTS

| | | | |
|---|---|---|---|
| 4,279,205 | 7/1981 | Perkins et al. | 110/245 |
| 4,419,965 | 12/1983 | Garcia-Mallol et al. | 122/4 D |
| 4,457,289 | 7/1984 | Korenberg | 122/4 D |
| 4,530,207 | 7/1985 | Brannstrom | 110/263 X |

FOREIGN PATENT DOCUMENTS

| | | |
|---|---|---|
| 3004846 | 8/1981 | Fed. Rep. of Germany . |
| 1600258 | 10/1981 | United Kingdom . |

*Primary Examiner*—Edward G. Favors

*Attorney, Agent, or Firm*—Pollock, Vande Sande & Priddy

[57] ABSTRACT

The invention relates to a method of igniting, upon start-up, a combustion chamber (8) in a power plant with combustion of fuel in a fluidized bed (14). The air flow through the nozzles (13) of the combustion chamber bottom (12) for fluidization of the bed (14) and for combustion of the fuel can be reduced upon start-up; bed material, which is heated to the ignition temperature of a start-up fuel, is transferred from a storage container (40) to the combustion chamber (8), and fuel is supplied to the bed (14). In those cases where the air flow has been reduced during the transfer of the bed material, it is increased again when the fuel is supplied. The invention also relates to a power plant having means for temporarily bypassing the nozzles (13) of the combustion chamber bottom (12) while transferring hot bed material from a storage container (40) to the combustion chamber (8), and a fuel system (30–38) for the supply of fuel to the combustion chamber (8). In a plant with a combustion chamber (8) enclosed in a pressure vessel (10), a connection with a valve (55) for by-passing the air flow may be provided between the space (11) in the pressure vessel and the freeboard (18) of the combustion chamber (8) for reducing the air flow through the bed. Further, control means (38, 80) are provided for carrying out the necessary operations of valves, and the like, during the start-up operation.

12 Claims, 2 Drawing Figures

Figure 1:
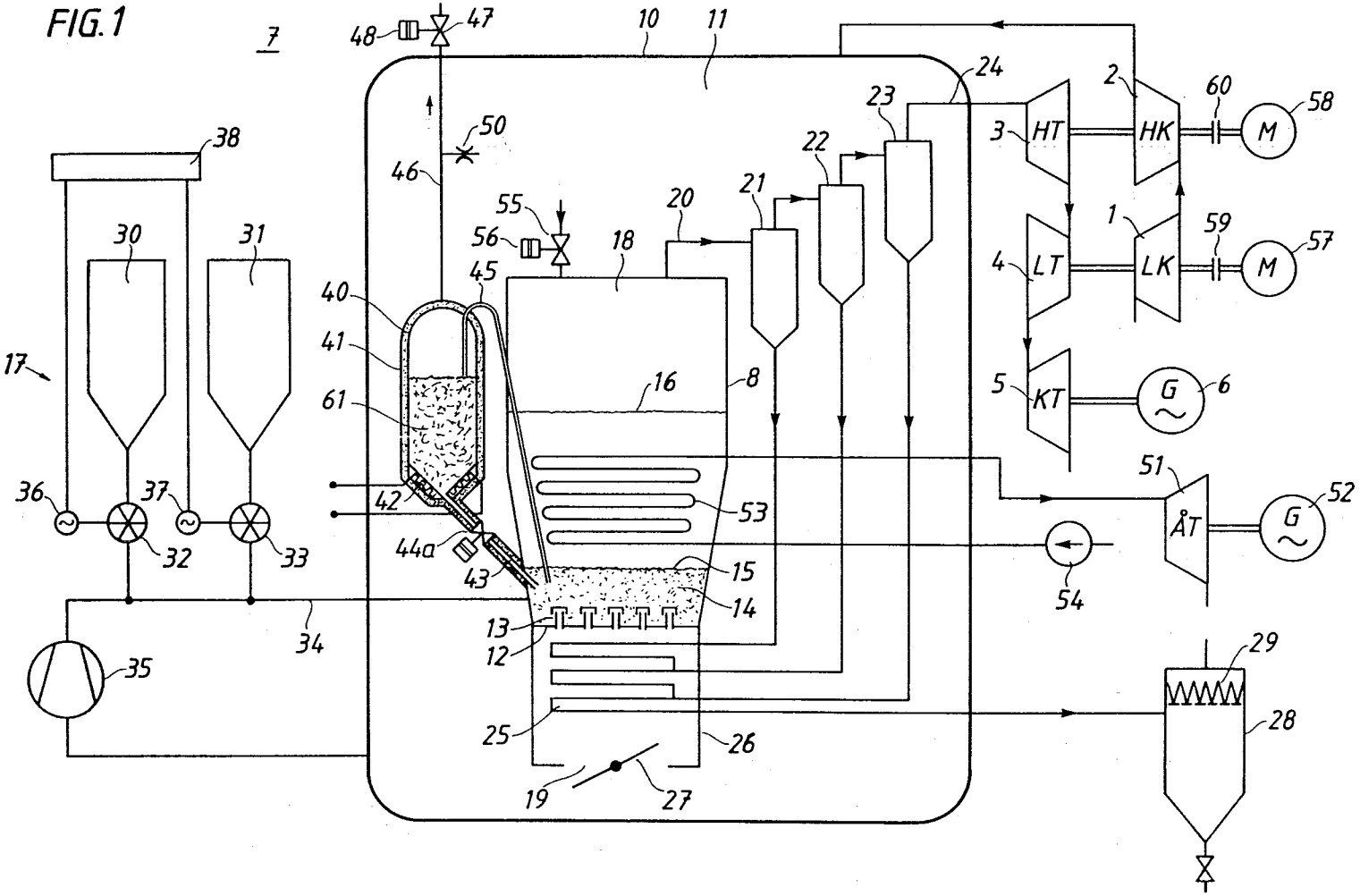

METHOD OF IGNITING A COMBUSTION CHAMBER WITH A FLUIDIZED BED AND A POWER PLANT FOR UTILIZING THE METHOD

TECHNICAL FIELD

The present invention relates to a method of igniting a combustion chamber with combustion in a fluidized bed, primarily in a power plant with a pressurized fluidized bed in a combustion chamber enclosed within a pressure vessel (a PFBC plant). Further, it relates to a power plant having means and devices for utilizing the method.

PRIOR ART

Numerous methods have been proposed and applied for start-up of the combustion in a fluidized bed. Common to most of them is that the entire bed or a limited part of the bed is heated by hot gas which is allowed to pass through and fluidize the bed. This gas is heated in special start-up combustion chambers which are fired, for example, by gaseous or liquid substances. Alternatively, the heating of the bed material is performed by combustion of gas directly in the bed, in the lower part thereof. As the bed temperatures rises, an increasingly large part of the supplied heat escapes with gases leaving the bed. Towards the end of the heating period, a stationary state is achieved, in which the temperature of the bed is approximately equal to that of the heating gas and all supplied heat escapes with the gases which leave the freeboard of the combustion chamber.

Swedish Pat. No. 7809559-3 with publication number 423,928 (corresponding to U.S. Pat. No. 4,378,206) discloses a combustion plant with a pressurized combustion chamber, in which the start-up bed material is heated to the ignition temperature with the aid of hot gas generated in a number of ignition combustion chambers and introduced into the bed through a number of nozzles.

THE INVENTION

According to the invention, ignition is performed in a combustion chamber in a power plant with combustion of a fuel in a fluidized bed, which is supplied with air for fluidization of the bed material and for combustion of supplied fuel with the aid of the bed material, which is stored in a separate storage vessel at a temperature which is equal to or exceeds the selfignition or spontaneous ignition temperature of a fuel. The heated bed material should be rapidly transferred to the combustion chamber and an ignition fuel be supplied to the heated bed material. To enable this rapid transfer, the heated bed material is stored in an isolated container separated from the combustion chamber and is transferred into the combustion chamber via a substantially vertical or greatly inclined conduit with a valve between the container and the combustion chamber. An ignition and start-up fuel is supplied to the heated bed material in connection with, or immediately after, the transfer to the combustion chamber. At a temperature of the transferred bed material corresponding to the operating temperature of the combustion chamber during normal operation, it is possible to use as ignition and start-up fuel the fuel used during normal operation. However, it is suitable to use a special startup fuel with a low self-ignition temperature. The temperature of the start-up bed material in the storage vessel may then be lower and a greater cooling of the bed material can be allowed in connection with the bed material being supplied to the combustion chamber. The temperature affects the choice of startup fuel. A more reliable ignition and start-up of the combustion chamber can be obtained if a special and suitably chosen start-up fuel is used. The bed material is heated to the normal operating temperature, usually to 750°–950° C., with startup fuel. During this heating, a change-over to normal fuel is successively made.

According to one method, the air flow through the nozzles of the combustion chamber botton is temporarily reduced, whereupon a bed material which is heated to the ignition temperature of the fuel is introduced into the combustion chamber. Cooling of the bed compound in connection with the transfer to the combustion chamber is thus reduced. Thereafter, the air flow through the bottom nozzles is again increased so that the hot bed material is fluidized. At the same time a fuel, suitably a special start-up fuel having a low self-ignition temperature, is added. The bed material is heated to normal operating temperature, often to about 750°–950° C., and at a suitable time during the heating, the start-up fuel is replaced, suitably successively, by the normal fuel for the plant. In a pressurized fluidized bed with a combustion chamber enclosed in a pressure vessel, the reduction of the flow through the bottom of the combustion chamber can be achieved by opening a valve in a connection between the pressure vessel space and the freeboard of the combustion chamber, so that the pressure difference between these spaces is reduced, thus bypassing some of the air.

According to another method, the start-up fuel is mixed with heated bed material during the transfer to the combustion chamber. In this case, start-up fuel is supplied to combustion air which constitutes activating gas for a so-called L-valve in the conduit for transfer of bed material to the combustion chamber. An advantage of this method is that the bed material is not cooled before fuel is supplied.

The power plant according to the invention contains at least one but suitably a plurality of isolated storage containers for bed material with a heating device for heating and/or sustaining the temperature of the bed material. From the container to the combustion chamber there is a conduit which permits rapid transfer of the hot bed material to the combustion chamber. Further, in a preferred embodiment, means are provided for temporarily reducing the air flow through the bottom of the combustion chamber and means are provided for supplying heat to bed material when this material is fluidized by increase of the air flow.

In a plant with a pressurized fluidized bed in a combustion chamber in a pressure vessel comprising compressed combustion air, there is suitably at least one connection, provided with a valve, between the pressure vessel space and the freeboard. Further, control means are provided for coordination of opening of this valve, transfer of heated bed material from the containers, closing of the valve and start-up of the supply of ignition fuel.

DRAWINGS

The invention will be described in greater detail with reference to the accompanying drawings, wherein FIG. 1 schematically shows a power plant and FIG. 2 an alternative embodiment of the storage container for heated bed material and the connection of the container to the combustion chamber.

PREFERRED EMBODIMENT

The power plant according to the invention comprises a low pressure compressor 1, a high pressure compressor 2, a high pressure turbine 3, a low pressure turbine 4 and a power turbine 5 which drives a generator 6. In a conventional manner, the embodiment is a three-shaft embodiment having the low and high pressure parts and the power turbine and the generator on their respective shafts. The embodiment shows only one of several possible arrangements and constitutes only one example.

Turbines 3, 4 and 5 receive their energy from a combustion chamber plant 7 with a combustion chamber 8 in a pressure vessel 10, i.e. a so-called PFBC plant. Compressors 1 and 2 feed the space 11 with combustion air. At full power the pressure may be 0.5–3.0 MPa. The combustion chamber 8 is provided with a bottom 12 provided with nozzles 13, through which the combustion chamber 8 is supplied with air for fluidization of the bed 14 and combustion of fuel supplied to the bed 14. The bed material is granular and may consist of sulphur absorbent, for example limestone or dolomite. The height of the bed varies with the load. The lowest bed surface is designated 15 and the highest bed surface is designated 16. The bed height may be varied by transferring bed material from the combustion chamber 8 to storage containers and returning it to the combustion chamber 8 in accordance with the method and equipment described in European patent application No. 84104821.8.

The fuel is fed into the bed 14 by means of a fuel system 17. Hot combustion gases produced in bed 14 accumulate in the freeboard 18 of combustion chamber 8 and leave the combustion chamber through conduit 20 and are cleaned from fly ash in cyclones 21, 22 and 23 and are led via conduit 24 to high pressure turbine 3. The figure shows a group of series-connected cyclones; in reality there are a number of parallel-connected such groups. Ashes and other dust from the bed which are separated in cyclones 21, 22 and 23 are fed out from the bed in a known manner, for example through an ash discharge device 25 of the kind described in greater detail in Swedish patent application No. 8205748-0 (corresponding to U.S. patent application (CIP) Ser. No. 563,427). This ash discharge device may be positioned in one or more air plenums or ducts 26 below the combustion chamber bottom 12. At the inlet 19 between duct 26 and space 11 there may be provided a valve 27, by means of which the air flow can be influenced. In case of a plurality of air ducts, the distribution of the air flow between the chambers can be influenced. Ash discharge device 25 is suitably located in the air flow in duct 26 and then simultaneously forms an ash cooler. From ash discharge device 25 the ash is led to a collection container 28, where the ash is separatd from the transport gas. This gas is cleaned in filter 29 before leaving container 28.

The fuel system comprises a first container 30 for normal fuel, for example crushed coal, which is used for normal operation of the plant, and a second container for ignition fuel, for example coconut shell, sawdust, wood chips, or the like, which has a low self-ignition temperature. Further, the fuel system comprises rotary vane feeders 32, 33 for feeding out fuel from containers 30 and 31 to fuel conveying pipe 34. Transport gas is obtained from compressor 35, which suitably takes its air from space 11. Rotary feeders 32, 33 are driven by motors 36 and 37, respectively, the speeds of revolution of which are controlled by means of control equipment 38, which communicates with transducers (not shown) in the plant. The fuel is introduced into bed 14 via a number of nozzles (not shown).

In the pressure vessel adjacent combustion chamber 8 there is at least one container 40 surrounded by heat insulation 41 for storing hot bed material. Container 41 is provided with a heater 42, suitably an electrical resistor element for keeping bed material or heating bed material to at least the self-ignition temperature of the fuel, which may be a special start-up fuel. Container 40 communicates with combustion chamber 8 by means of a first conduit 43 provided with a mechanical valve **44*a* in the embodiment according to FIG. 1, or an L-valve 44*b* in the embodiment according to FIG. 2, for transfer of hot bed material to the combustion chamber, and a second conduit 45 for transfer of bed material from combustion chamber 8 to container 40. In the embodiment with an L-valve according to FIG. 2, there is provided a conduit 39 with a valve 49, through which the L-valve can be supplied with air from space 11 for fluidizing the material in the L-valve 44*b* and for removing the blocking function of this valve. A booster compressor 70 may possibly be provided in conduit 39. Conduit 43 should have such conveying capacity that the bed material in container 40 may be very rapidly, preferably in less than 30 seconds, transferred to the combustion chamber. Via conduit 46 with valve 47, which is operated by operating device 48, container 40 can be put into connection with a space having lower pressure than fluidized bed 14. In this way the pressure in container 40 may be reduced so that transport of bed compound from combustion chamber 8 to container 40 through conduit 45 is obtained. Conduit 46 is suitably connected with space 11 via a throttle means 50, thus obtaining a permanent small air flow. In the event of a leaking valve 47, this air flow prevents the outflow of hot gas from combustion chamber 8 through valve 47**. A similar storage container and the method of transferring bed material between container and combustion chamber, but only for control of the bed level, are disclosed in European patent application No. 84104821.8.

Special start-up fuel can be supplied to the activating air in conduit 39 from a separate start-up fuel container 71. Between container 71 and conduit 39 there is a rotary feeder 72 or other means for controlling the fuel flow. Drive motors 73 and 74, respectively, of booster compressor 70 and rotary feeder 72 are connected via control conductors 76, 77, 78 to a common control equipment 80.

Figure 2:
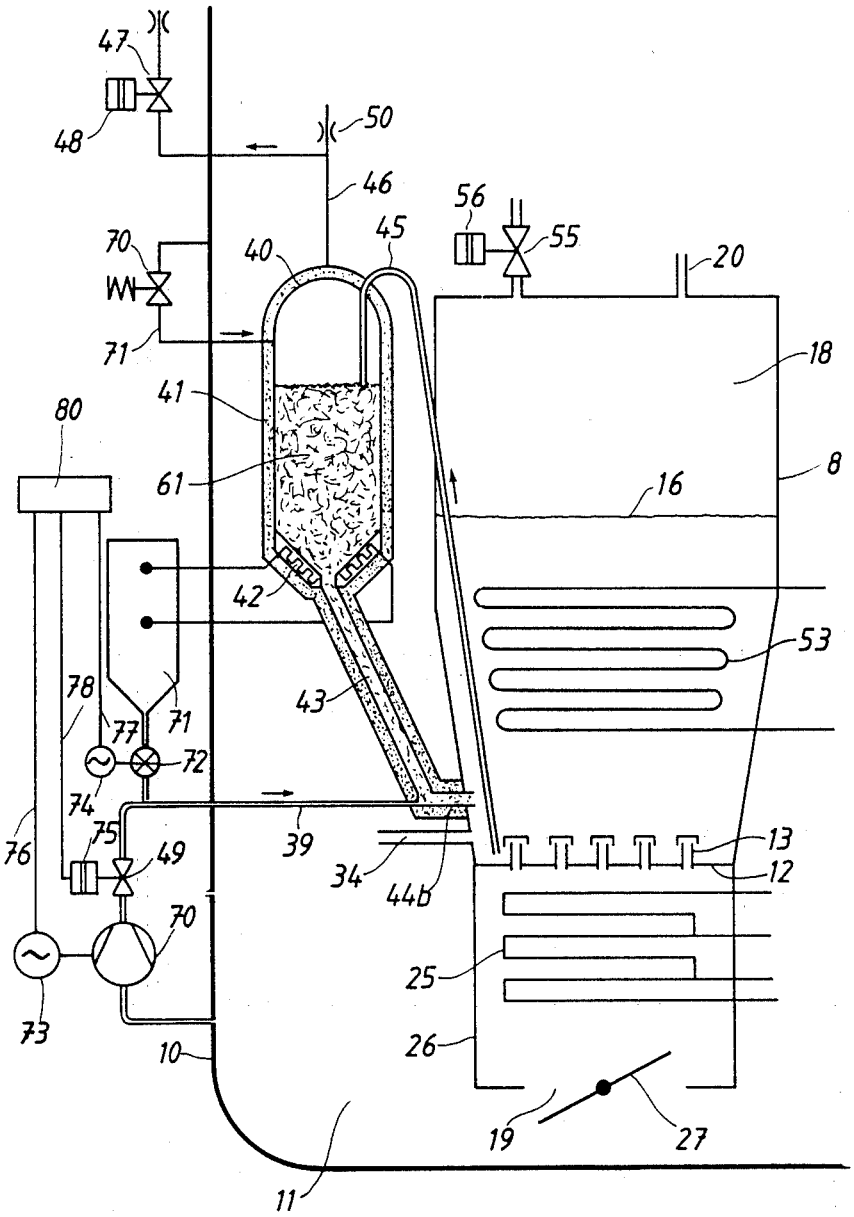

By using an L-valve **44*b* in the steeply inclined conduit 43, as shown in FIG. 2**, no mechanical movable valve parts are needed in the supply conduit for the hot bed material. Further, a very great bed material flow with a very insignificant amount of gas for activation of the valve can be achieved. For supply of about 500 kilos of bed material, only about 1 kilo transport gas is needed. In a conveyor tube with a diameter of about 150 mm, a flow of 10–20 kilos of bed material per second may be achieved.

The plant includes a steam turbine 51 which drives a generator 52. Steam for this turbine 51 is generated in a tube coil 53 in combustion chamber 8. This tube coil is completely inside the fluidized bed 14 at full combustion chamber power and maximum bed height. Tube coil 53 is supplied with feed water through a feed water pump 54 from a feed water tank (not shown).

Freeboard 18 of combustion chamber 8 can be put into communication with space 11 in pressure vessel 10 through a valve 55 (by-pass valve) with an operating device 56, whereby the pressure difference between these two spaces drops. The air flow through nozzles 13 of bottom 12 is reduced or terminates completely when valve 55 opens.

Low pressure compressor 1 and high pressure compressor 2 are connectible to starter motors 57 and 58, respectively, by means of couplings 59 and 60, respectively.

Upon start-up of the plant, starter motors 57 and 58 are connected to compressors 1 and 2 and air is pumped into pressure vessel space 11. A certain air flow is obtained through the combustion chamber. The flow resistance in valve opening 19, air duct 26, nozzles 13 and possible bed material in bed 14 results in a pressure drop so that a pressure difference arises between space 11 in pressure vessel 10 and freeboard 18. When a chosen suitable pressure has been obtained in space 11, valve 55 is opened so that a pressure equalization is obtained between space 11 and freeboard 18. The flow resistance in valve 55 determines the remaining pressure difference and the continued air flow through bottom 12. This latter flow should be low, and therefore valve 55 should have a large area and provide little resistance. The valve area should be larger than the total area of nozzles 13, suitably it should be many times greater. The greater part of the air flow to combustion chamber 8 passes through valve 55. Suitably, valve 55 should be dimensioned so that the main part of the air flow, 70–90%, passes through valve 55 and only a small part through nozzles 13.

Bed material 61, which is heated to a suitable ignition temperature, 600°–900° C., is present in container or containers 40. Valve **44*a* in the conduit is opened or L-valve 44*b* is supplied with transport air, and bed material 61 falls down into combustion chamber 8 through conduit 43. This conduit 43 should have a large area so as to achieve quick feeding of bed material into the combustion chamber. The aim is to bring about a minimum bed height for stable fluidization and combustion in about 30–60 seconds. To achieve such fast feeding, it may be necessary to use a plurality of containers 40. The necessary bed material temperature depends, among other things, on how fast the feeding of bed material can be achieved, on the cooling air flow through nozzles 13** during the feeding, and on the ignition temperature of the fuel used during start-up of the combustion chamber.

When a minimum bed has been achieved, valve 55 is shut, the pressure difference between space 11 and freeboard 18 is increased, and the entire air flow passes nozzles 13 and the material in minimum bed 14 is fluidized. The fluidization becomes almost instantaneous. At the same time the fuel feed is started. The temperature of bed 14 must exceed the self-ignition temperature of the fed-in fuel. At very high bed temperature it is possible to use the ordinary fuel, for example crushed coal, when igniting the combustion chamber. To reduce the stresses caused by sudden changes in temperature, a certain preheating of the combustion chamber prior to ignition is desirable as well as a relatively low bed material temperature. It may therefore be suitable to use a special start-up fuel which is ignited at a low temperature. Crushed nutshells, especially from coconuts, sawdust or wood chips constitute suitable start-up fuels. Also liquid and gaseous ignition fuels may be used.

To enable several starting attempts in the event that the first starting attempt should fail, the plant is suitably equipped with a plurality of containers 40. One or more of them can be utilized for each starting attempt. As shown in FIG. 1, one container 40 has not been used and is thus filled with bed material 61 also after start-up of combustion chamber 8. FIG. 2 illustrates an extinguished combustion chamber 8, which is emptied of bed material.

I claim:

1. A method of igniting a combustion chamber in a power plant for combustion of fuel in a fluidized bed of particulate bed material which is supplied with air at the bottom of the combustion chamber for fluidization of the bed and for combustion of fuel supplied to the bed, characterized in that bed material heated to at least the self-ignition temperature of a fuel is stored in an isolated container, separated from the combustion chamber, at a level above the bottom of the combustion chamber, that heated bed material is transferred to the combustion chamber via a vertical or greatly inclined conduit with a shut-off device, and that a startup fuel is supplied to said bed material in connection with or immediately after the transfer to the combustion chamber.

2. A method according to claim 1, characterized in that the air flow to the nozzles of the combustion chamber bottom is reduced, that the bed material, heated to at least the self-ignition temperature of a fuel, is introduced into the combustion chamber, whereafter the air flow through the nozzles at the bottom of the combustion chamber is increased so that the bed material is fluidized and a fuel which is ignitable at the bed material temperature in question is supplied to the bed.

3. A method according to claim 2, characterized in that in a power plant with a pressurized fluidized bed in a combustion chamber enclosed in a pressure vessel, the reduction of the air flow through the nozzles of the combustion chamber bottom is brought about by opening a connection between the pressure vessel and the freeboard of the combustion chamber.

4. A method according to claim 2, characterized in that in a power plant with a pressurized fluidized bed in a combustion chamber enclosed in a pressure vessel, the reduction of the air flow through the nozzles of the combustion chamber bottom is brought about by a throttle means upstream of the combustion chamber bottom.

5. A method according to any of claims 1–4, characterized in that the bed is supplied with a special, inflammable start-up fuel.

6. A method according to any of claims 1–4, characterized in that the bed is supplied with an inflammable fluid or gaseous start-up fuel.

7. A method according to any of claims 1 or 2, characterized in that the fuel used for normal operation is also used as start-up fuel.

8. A method according to claim 5, characterized in that the start-up fuel consists of crushed nutshells from, for example, coconuts, wood chips or sawdust.

9. A method according to claim 1, characterized in that heated bed material is supplied with start-up fuel and combustion air during the transfer from the storage container to the combustion chamber.

10. A method according to claim 9, characterized in that start-up fuel is mixed into combustion air which constitutes activating gas for an L-valve arranged in the steeply inclined coduit.

11. A power plant for combustion of fuel in a fluidized bed of particulate bed material, which is supplied with air at the bottom of the combustion chamber for fluidization of the bed and combustion of fuel supplied to the bed, which combustion chamber is intended to be ignited according to the method stated in claims 1–8, characterized in that it comprises at least one isolated storage container, separated from the combustion chamber, for storage of bed material heated to the self-ignition temperature of the fuel, means for heating and/or sustaining the temperature of this bed material, a vertical or greatly inclined conduit between this container and the combustion chamber for transfer of the bed material from the container to the combustion chamber, a shutoff device in this conduit and means for supplying fuel to the bed of bed material transferred to the combustion chamber in connection with, or immediately after, the transfer of the bed material to the combustion chamber.

12. A power plant according to claim 9, characterized in that in a plant with a pressurized fluidized bed in a combustion chamber enclosed in a pressure vessel with combustion air under pressure, the storage container is located inside the pressure vessel and an openable connection is arranged between the freeboard of the combustion chamber and the surrounding space in the pressure vessel, said openable connection being held open during the transfer of heated bed material from the container to the combustion chamber so that the air flow through the bed is reduced for the purpose of reducing the cooling of bed material transferred to the combustion chamber.

* * * * *